US007341101B1

(12) United States Patent
Moretz

(10) Patent No.: US 7,341,101 B1
(45) Date of Patent: Mar. 11, 2008

(54) ENCLOSED RADIAL WIRE-LINE CABLE CONVEYING METHOD AND APPARATUS

(76) Inventor: Benny W. Moretz, P.O. Box 80567, Lafayette, LA (US) 70598

( * ) Notice: Subject to any disclaimer, the term of this patent is extended or adjusted under 35 U.S.C. 154(b) by 52 days.

(21) Appl. No.: 11/443,134

(22) Filed: May 30, 2006

Related U.S. Application Data

(63) Continuation-in-part of application No. 10/396,054, filed on Mar. 24, 2003, now Pat. No. 7,051,803.

(51) Int. Cl.
*E21B 19/22* (2006.01)

(52) U.S. Cl. ..... 166/77.1; 166/241.5

(58) Field of Classification Search ..... 166/77.1, 166/385, 384, 84.1, 77.2, 77.3, 84.4, 241.5, 166/241.6
See application file for complete search history.

(56) References Cited

U.S. PATENT DOCUMENTS

| | | | | |
|---|---|---|---|---|
| 2,810,439 | A | 10/1957 | Johnson et al. | |
| 3,363,880 | A | 1/1968 | Blagg | |
| 3,496,998 | A | 2/1970 | Weaver | |
| 3,762,725 | A | 10/1973 | Taylor | |
| 3,941,296 | A * | 3/1976 | Ziemek | 228/148 |
| 4,091,867 | A | 5/1978 | Shannon et al. | |
| 4,577,693 | A | 3/1986 | Graser | |
| 5,188,173 | A | 2/1993 | Richardson et al. | |
| 5,392,861 | A | 2/1995 | Champagne | |
| 5,516,211 | A * | 5/1996 | Barnes et al. | 384/49 |
| 5,662,312 | A | 9/1997 | Leggett et al. | |
| 6,006,839 | A | 12/1999 | Dearing et al. | |
| 6,247,340 | B1 | 6/2001 | Newman | |
| 6,516,892 | B2 | 2/2003 | Reilly | |
| 6,764,103 | B1 | 7/2004 | Moretz | |
| 2004/0118556 | A1 | 6/2004 | Widney | |

* cited by examiner

*Primary Examiner*—Jennifer H. Gay
*Assistant Examiner*—Daniel P. Stephenson
(74) *Attorney, Agent, or Firm*—Robert N. Montgomery

(57) ABSTRACT

A relatively light weight wire-line conveyance mechanism capable of sustained high pressure incorporated into a wire-line riser set-up and configured to allow multiple radial bends without sheaves. The conveyance mechanism includes a tubular body structure capable of being pressurized defining a radial arc of between 0 and 180 degree having a threaded coupling at each end for connection to riser tubular joints. One embodiment discloses a field formable cable conveyor that may take a variety of shapes. The tubular body contains a series of connected tubular blocks or sleeves, each of which includes a longitudinal bore and a roller or ball bearing assembly therein defining a wire-line pathway for receiving a wire-line that passes through each of said tubular blocks, fully contained therein.

13 Claims, 10 Drawing Sheets

ENCLOSED RADIAL WIRE-LINE CABLE CONVEYING METHOD AND APPARATUS

This is a Continuation-in-Part application of U.S. application Ser. No. 10/396,054 filed Mar. 24, 2003, now U.S. Pat. No. 7,051,803.

1. FIELD OF THE INVENTION

This invention relates generally to wire-line equipment used in conducting down-hole well operations including well completion activities, well servicing activities, and the installation and removal of various down-hole well tools. More particularly, the present invention concerns an enclosed radial cable conveyance mechanism through which a wire-line passes as the wire-line is being run into or extracted from a well bore and wherein the conveyance mechanism is capable of containing well pressures in the range of 10,000 psi or greater and to provide for continuous grease injected sealing of the wire-line while in a verity of configurations.

2. BACKGROUND OF THE INVENTION

It is frequently necessary during drilling or completion operations to conduct well bore logging activities. Such activities involve the use of a logging tool run into the well to evaluate the progress of the well's bore and to identify various characteristics of the earth formation adjacent the well bore. Logging operations are typically carried out by running various logging tools into the well using a variety of wire-line cables. Various other well servicing activities are often conducted using down-hole tools that are run into well bores or well casing using wire-line apparatus. When wells are being logged or completed on live wells high-pressure conditions are often encountered. When such high pressures are encountered, wire-line pipe risers of significant height are often employed within the well derrick or above the well head in order to provide the wire-line pipe risers with sufficient length to house the down-hole tool and a sufficient length of weight bar to overcome the well pressure and thus pull the tool and its logging cable into the well bore. These wire-line risers incorporate grease wipers and/or wire-line packers in addition to various valves necessary to render the wire-line apparatus safe for containing the well's pressure.

Typically an open upper sheave is mounted above the wire-line riser and the wire-line cable being run into or exiting the well extends above the riser and passes around the upper sheave and thence downwardly to a lower sheave near drill floor level in route to a wire-line cable winch typically mounted on a wire-line service vehicle located adjacent the derrick. More recently, rather than providing extremely tall wire-line risers, especially where the height of the wire-line riser may be restricted, it has become customary to provide a pressure containing upper sheave which may be located at the upper end of a wire-line riser and incorporated therein and to provide a grease seal conduit extending downwardly from the upper pressure-containing sheave head thus providing a wire-line riser containing apparatus of sufficient length for efficient pressure containing capability but with approximately half overall height. An example of a pressure-containing sheave disposed in pressure connection with a wire-line riser and a grease seal conduit is presented by U.S. Pat. No. 5,188,173 of Richardson, et al, and U.S. Pat. No. 5,662,312 of Leggett, et al. These types of pressure-containing sheaves have deficiencies in that they are restricted relative to their weight and pressure containing capability due to the significant area of the housings. The housings are also subject to considerable pressure induced side loading that, especially under high-pressure conditions, can significantly distort the body structure to the extent that the sheaves can become inoperative. It is therefore desirable to provide a light weight, radial pressurized cable conveyance mechanism having high pressure capability for wire-line well servicing apparatus and other completion activities utilizing wire-line services that are also configurable to produce multiple radial bends that reduce or eliminate the need for open or closed sheaves all together.

3. SUMMARY OF THE INVENTION

The instant invention is a relatively light weight radial wire-line conveyance mechanism capable of sustained high pressure which may be incorporated into a wire-line riser configuration and configured to allow multiple radial bends thus eliminating the need for sheaves. The features of this invention are realized through the provision of a tubular body structure capable of being pressurized defining a radius between 0 and 180 degrees including a threaded connection at each end or by any other suitable means for connection to down-hole tubular joints. The tubular body structure defines an internal bore within which is located a series of connected tubular blocks each of which includes a longitudinal bore and roller therein defining a wire-line pathway for receiving a wire-line that passes through each of said tubular blocks located throughout the body structure. The rollers in each of the tubular blocks are directly lubricated by grease that is continuously pumped into the internal bore.

It therefore is an object of the radial wire-line conveyance mechanism or carrier to reduce the overall height of the wire-line lubricator string resulting from crane height limitations.

Another object of the invention is to reduce pollution by reducing the height of the external sheave and grease head associated with wire-line operations.

Yet another object of the invention is to eliminate wire-line cable from jumping external sheaves.

Another object of the invention is to reduce length of lubrication hoses associated with wire-line injection operations and thus increase visibility of the wire-line insertion operation by reducing the illuminated area required.

Still another object of the invention is to prevent spinning and twisting of the wire-line by the wire-line sheave.

Yet another object of the invention is to simplify pick-up and lay-down of lubricator and eliminating external top sheaves in some cases.

Another object of the invention is to provide an enclosed, pressurized, radial, light weight wire-line conveyor that reduces bearing loading, especially with large diameter cable.

Still another object of the invention is to provide a means for radially conveying a wire-line in multiple planes thereby permitting pivotal "Chickson" type lubricator section set up for wire-line operations.

These and other objects may be better seen and described by the drawings and detailed descriptions to follow.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMRODIMENT

Figure 1:
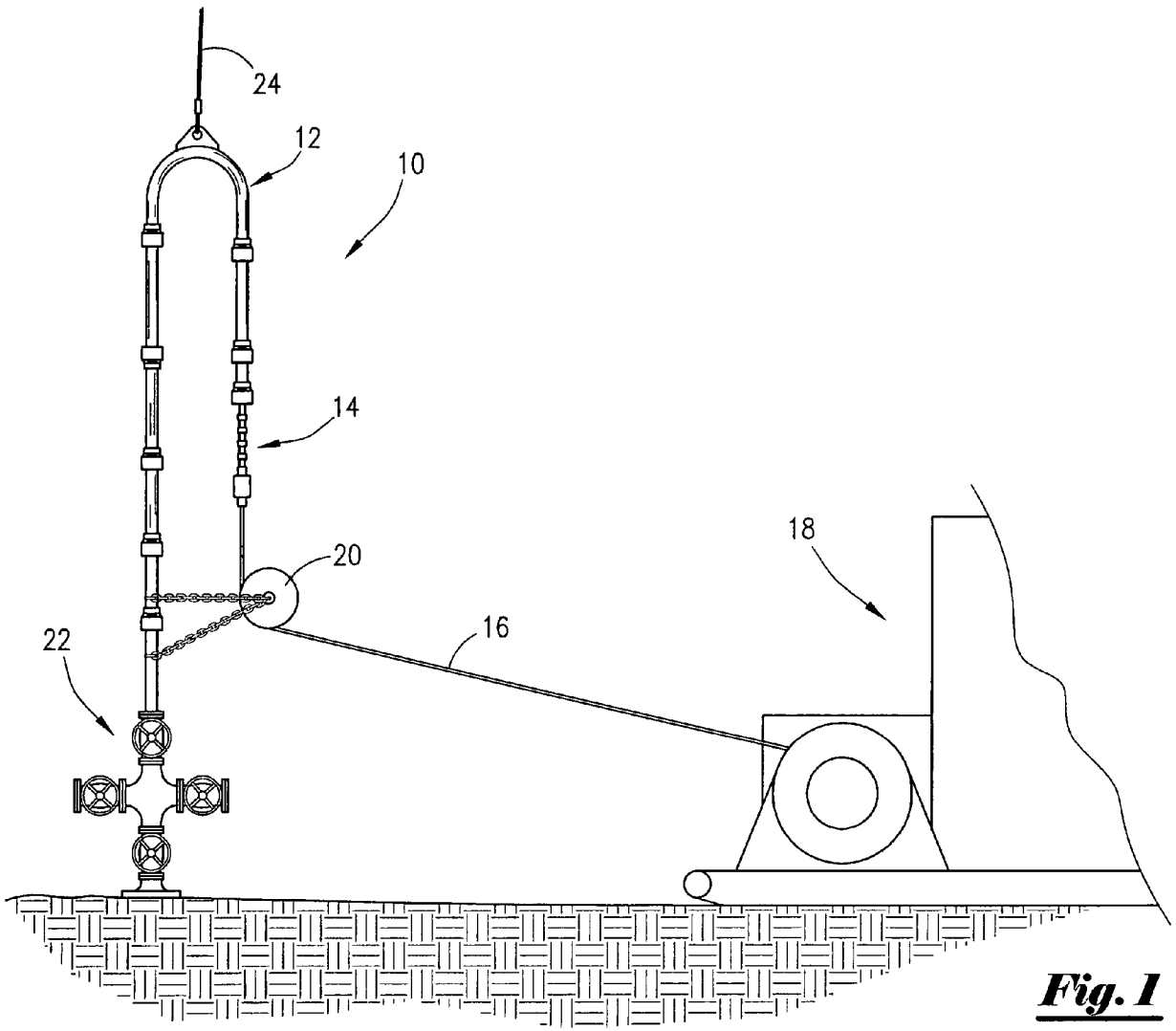
FIG. 1 is vertical elevation view of the preferred embodiment of the radial cable conveyer adapted to a wire-line riser attached to a wellhead and supported by crane.

The wire-line cable riser rig-up assembly 10 illustrated in FIG. 1 would seem to be impractical due to the friction and wear factors associated with simply bending a pipe or tube as seen at the top of the riser in a 180-degree arch. However, as disclosed herein, utilizing a 180-degree cable conveyer located within the tubular member to form a high pressure, wire-line cable conveyor assembly 12, allows the grease head assembly 14 to be located closer to ground level. The arrangement further eliminates the need for a large, heavy diameter sheave and the problems associated therewith when this arrangement is currently attempted. The wire-line 16 can still be fed to the grease head assembly 14 from the reel assembly 18 utilizing the lower temporary sheave 20. The riser assembly 10 in this embodiment is illustrated as being attached to a wellhead assembly 22 and supported by a crane cable 24.

Figure 2:
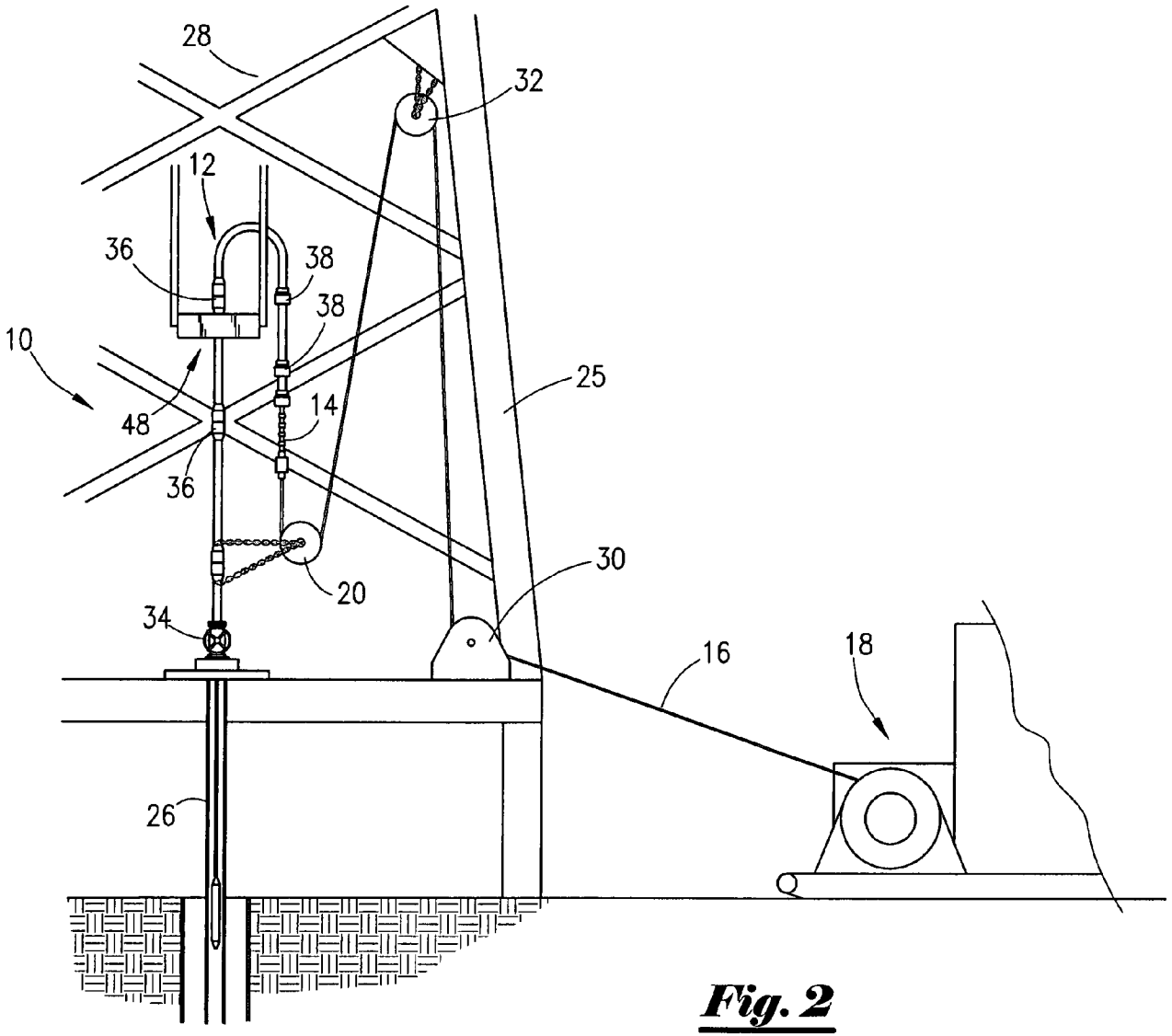
FIG. 2 is vertical elevation view of the preferred embodiment of the radial cable conveyer adapted to wire-line riser with free-point rig-up in a derrick.

As illustrated in FIG. 2, the 180-degree cable conveyor assembly 12 and riser assembly 10 may be utilized with a derrick 25 in a free-point rig-up arrangement whereby the riser assembly 10 and multiple joint sections of pipe located within the well bore 26 may be lifted by the rig cable line 28 by utilizing a free-point riser set-up as shown here. In this case the wire-line cable 16 is passed though a deck sheave 30 to an intermediate derrick supported sheave 32 before being passed to the lower temporary sheave 20 leading vertically to the grease head 14. In this arrangement a temporary shut-in valve 34 is used to close off wellhead pressure leading to the riser assembly 10. It should also be noted that due to excessive weight on the joints, lifting requires threaded pipe joints 36 rather than Bowen™ (registered mark of Bowen Tool, Inc.)-type quick couplings generally used for making up wire-line riser assemblies. However, when using the bent cable conveyer assembly 12 as illustrated in FIG. 2, joints located between the conveyer assembly 12 and the lower sheave 20 can still use the Bowen™ quick fittings.

Figure 3:
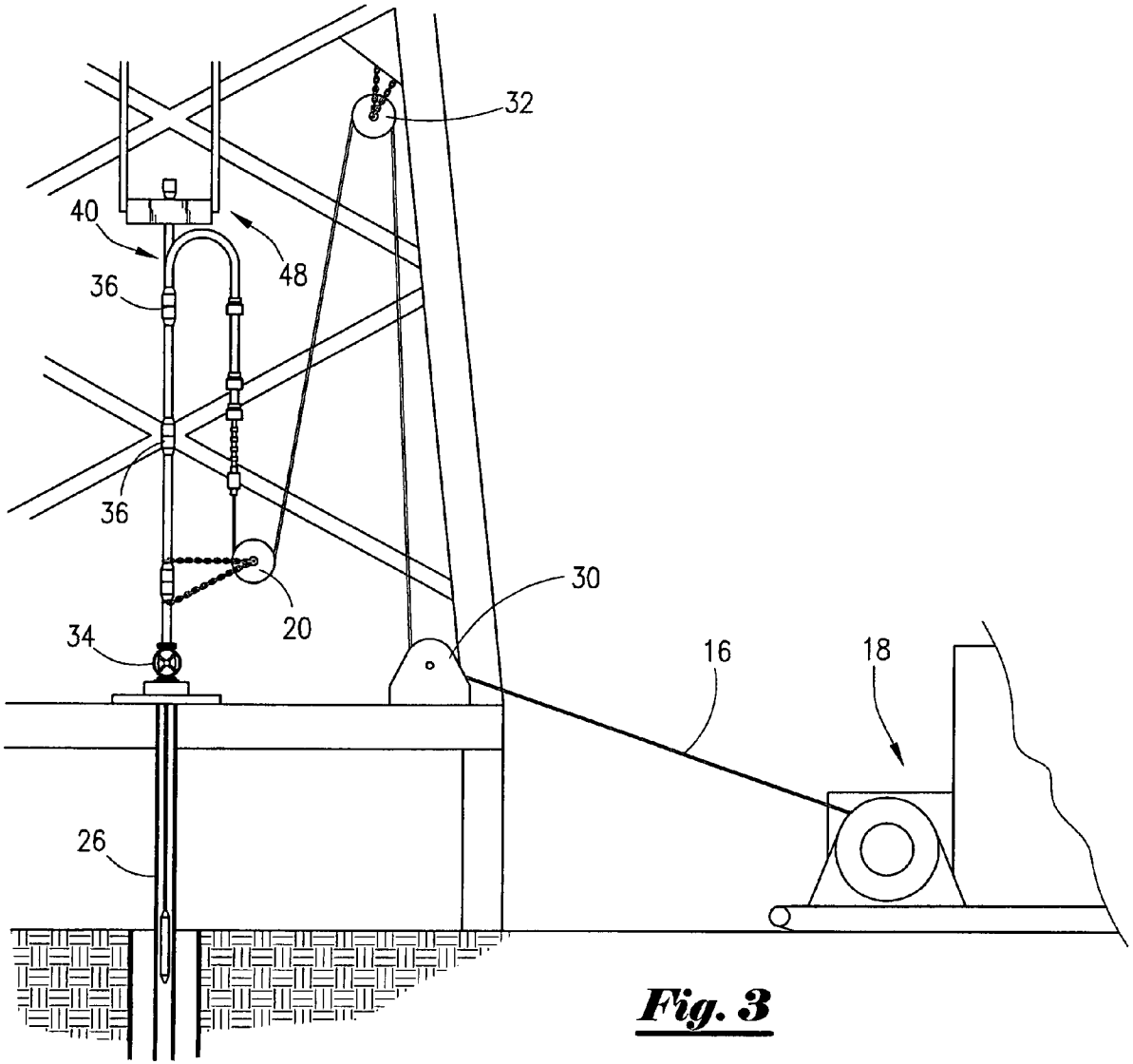
FIG. 3 is a vertical elevation view of a second embodiment of the radial cable conveyer and wire-line riser with free-point rig-up in a derrick adapted for use with top drive.
Figure 4:
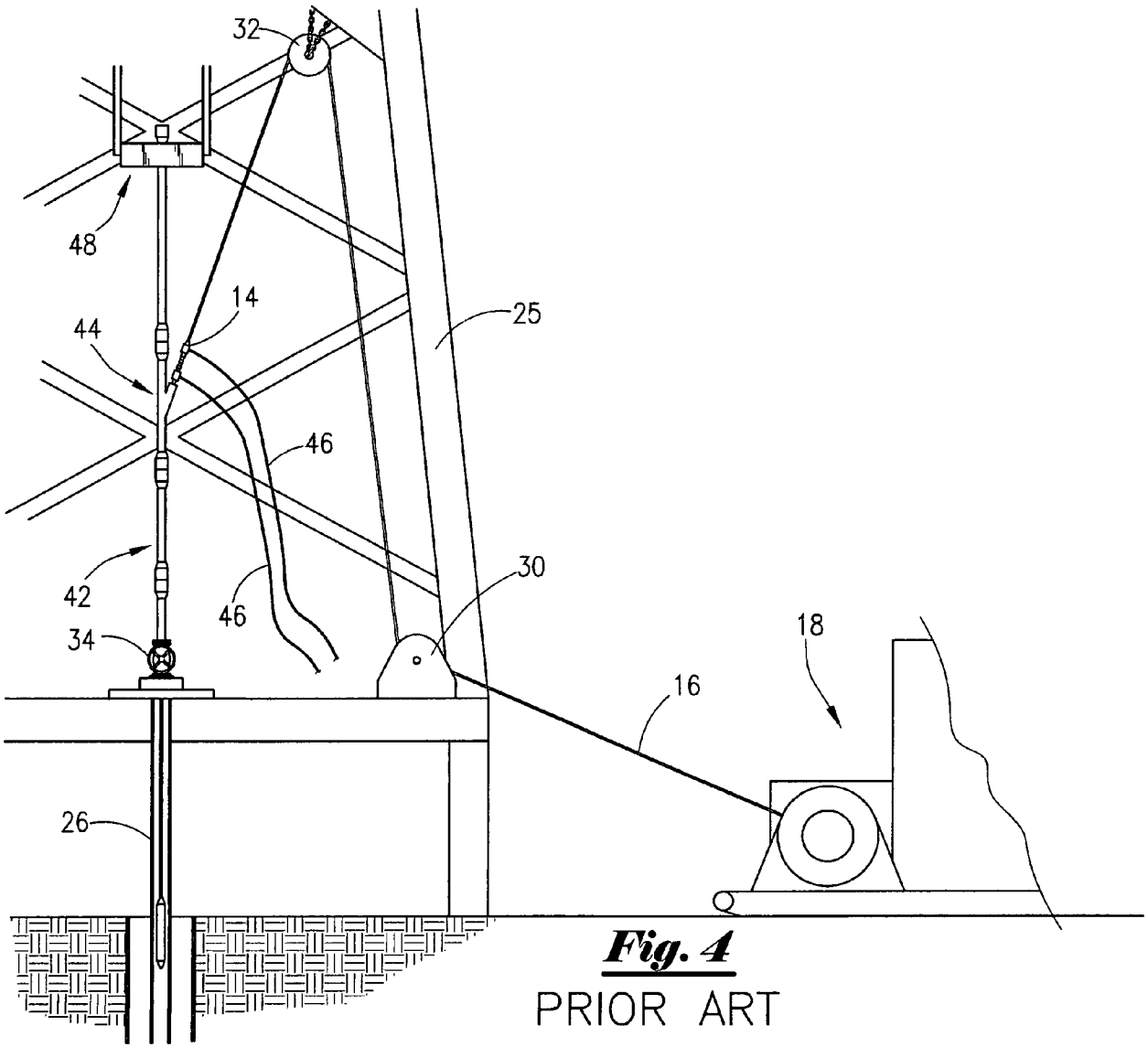
Fig. 4 PRIOR ART
FIG. 4 is a vertical elevation view of the prior art free-point rig-up.

Looking now at FIG. 3 we see that the same set-up and riser assembly seen in FIG. 2 may be used with a top drive derrick. However, in this case, the bent 180 degree cable conveyer assembly 12 in the previous figures has now been modified for top drive connection and lifting apparatus by forming an "h" configuration designated here as item 40 and referred to as the top drive 180 degree cable conveyor. This configuration is by far easier to control than the "Y" arrangement in current practice as illustrated in FIG. 4. In this configuration the riser assembly 42 is by necessity quite lengthy, thus placing the "Y" sub 44 and the grease head 14 very high in the derrick 25, requiring very long grease lines 46. The arrangement also utilizes the elevators 48 for lifting the pipe string and riser assembly 42 from the well bore 26.

Figure 5:
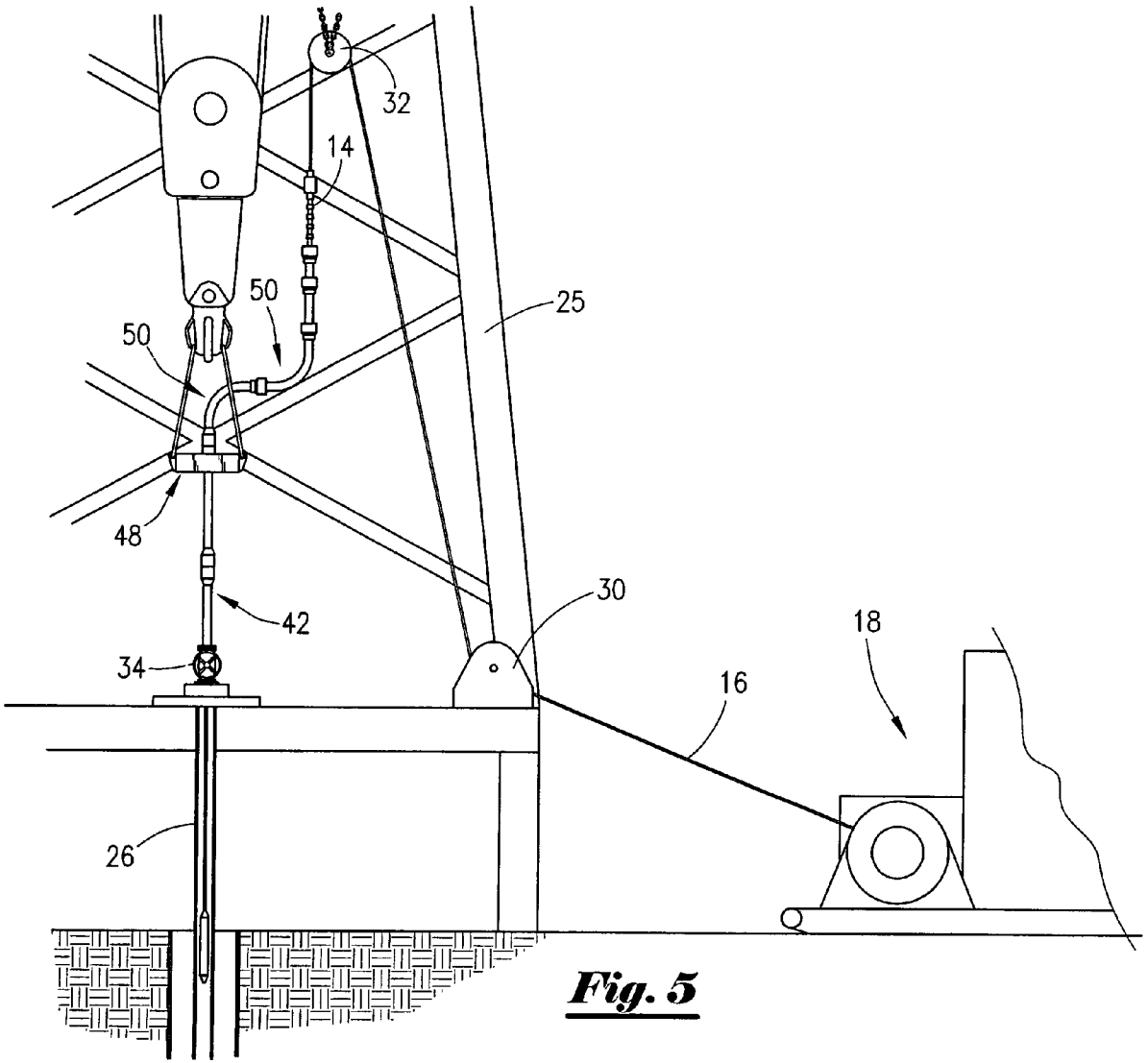
FIG. 5 is a vertical elevation view of a third embodiment of two 90-degree radial cable conveyers connected in tandem in a free point riser rig-up for use with elevators.

In some cases it may be advantageous to route the wire-line riser assembly high in the derrick with a free-point arrangement as seen in FIG. 5 without using the "Y" sub 44 shown in FIG. 4. In this case the riser assembly 42 is supported or lifted by the elevators 48 and the wire-line cable 16 is fed through on two sheaves, the temporary derrick sheave 32 and deck sheave 30. However, the traveling block from which the elevators 48 are suspended creates interference problems with the grease head if allowed to remain vertical along the centerline of the wellhead. Therefore, by utilizing a pair of 90-degree high-pressure wire-line conveyer assemblies, 50 the grease head can be offset to avoid the traveling block.

Figure 6:
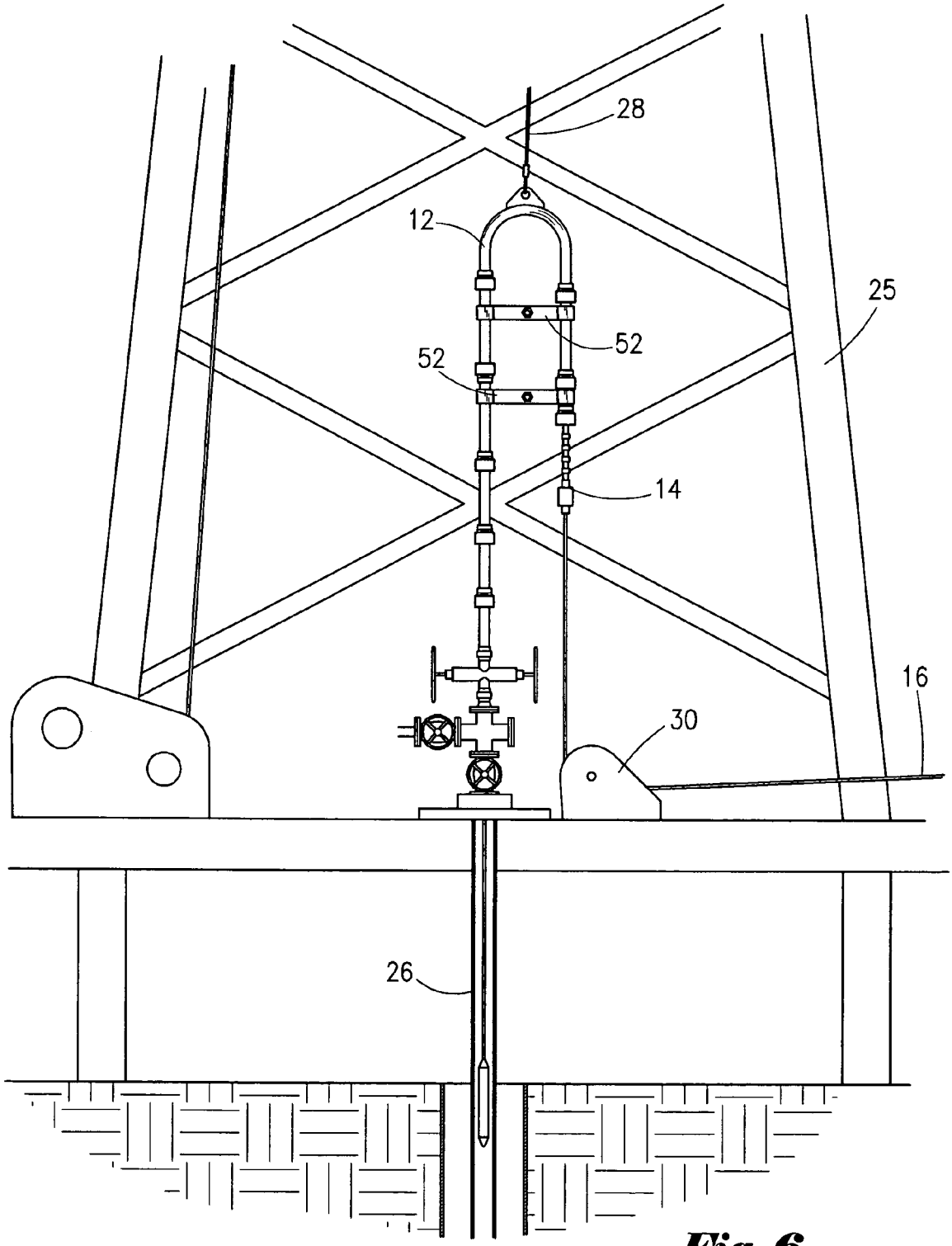
FIG. 6 is a vertical elevation view of a fourth embodiment of a radial cable conveyer with parallel riser member connector bracing.

In some cases the bent riser assembly, as previously described in FIG. 1, forming "U" shape of parallel riser members may need additional cross bracing between the parallel riser members as seen in FIG. 6 to insure unit integrity. This may be achieved with one or more pipe hanger clamps 52.

Figure 7:
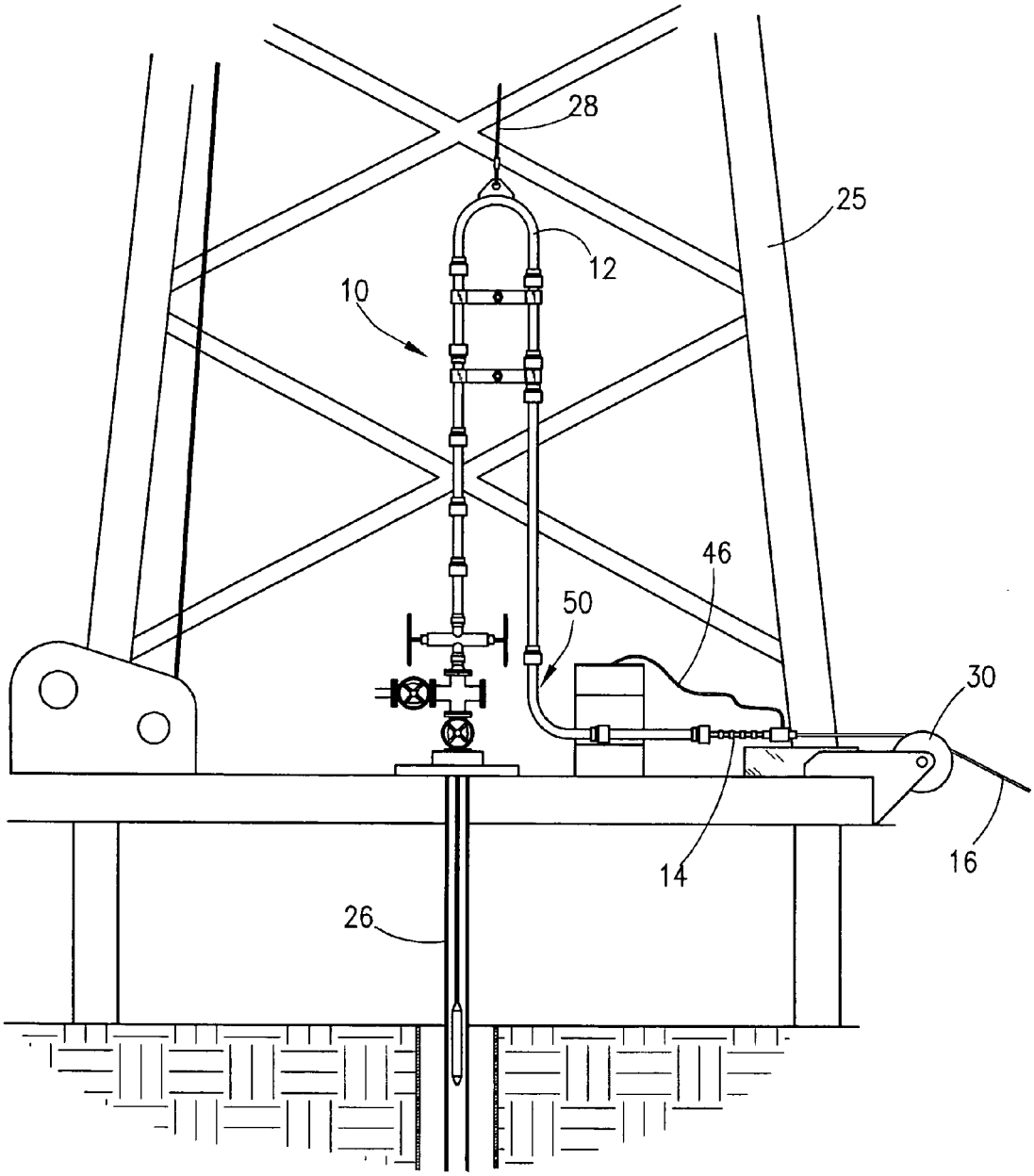
FIG. 7 is a vertical elevation view of a fifth embodiment utilizing multiple radial cable conveyers within a wire-line.

As illustrated in FIG. 7 the riser assembly previously illustrated in FIGS. 1 and 7 may also include additional conveyor assemblies 50 as necessary to route the wire-line to the cable reel by the shortest and most direct route, thereby reducing stress on the cable.

Figure 8:
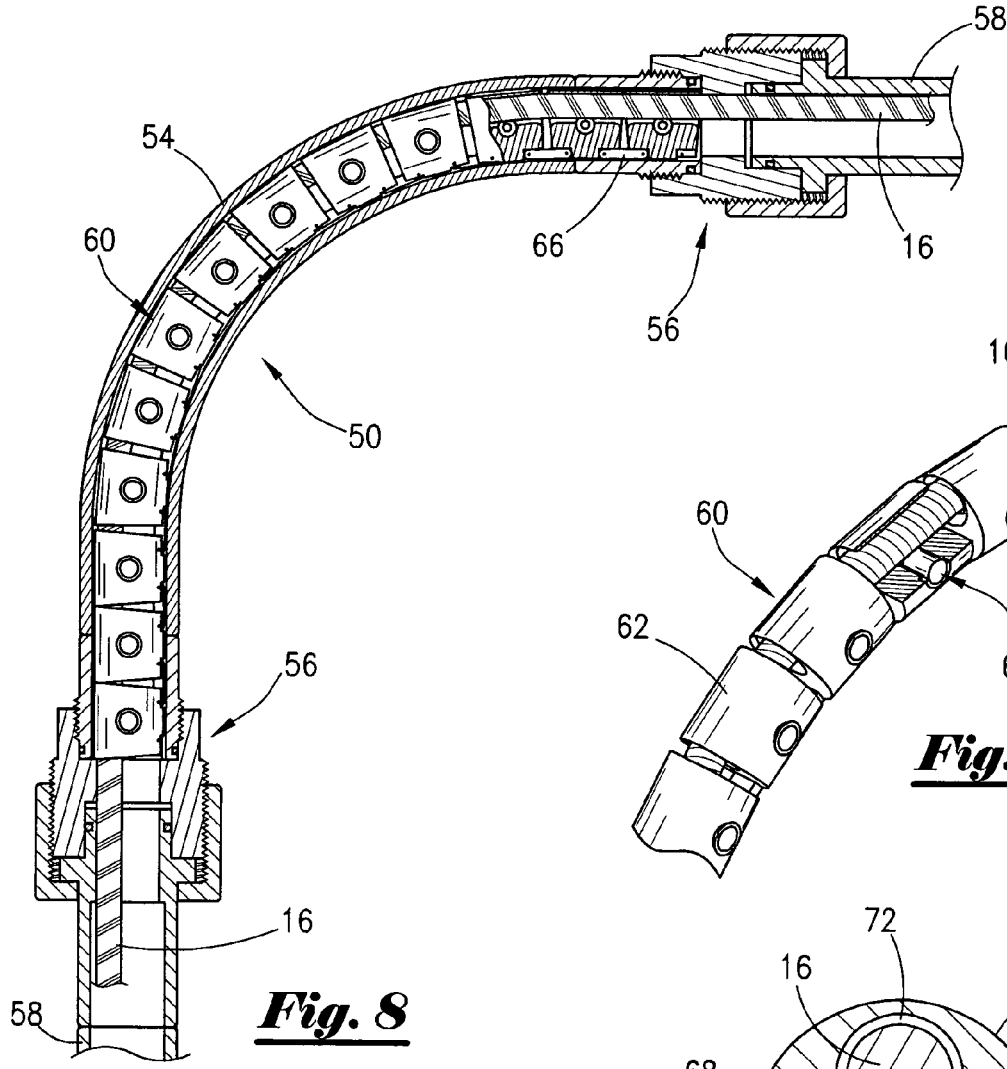
FIG. 8 is a cross-section view of the radial cable conveyer capable of being pressurized.
Figure 9:
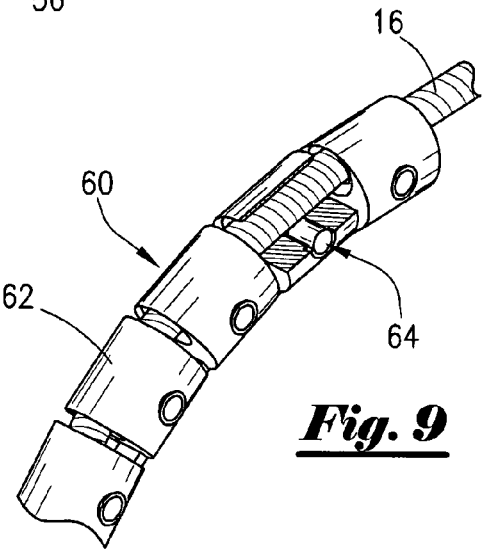
FIG. 9 is a partial isometric view with cut-away view of the roller assembly.
Figure 10:
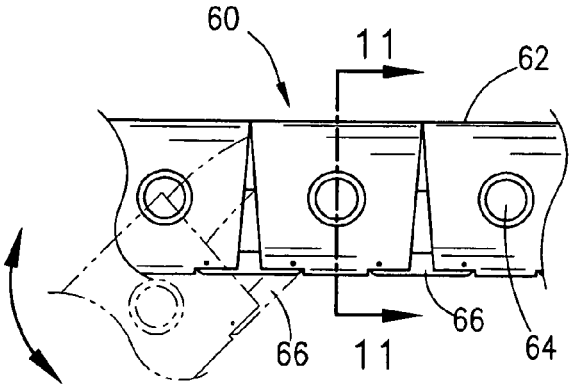
FIG. 10 is a side view of the roller assemblies connected in tandem showing pivotal movement in phantom.
Figure 11:
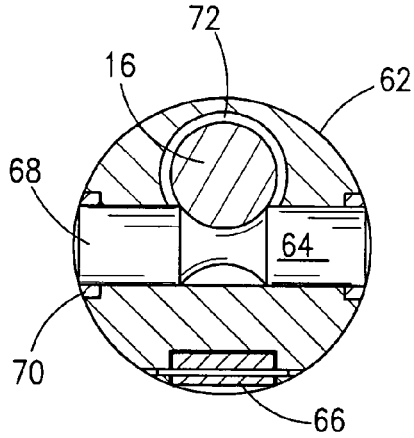
FIG. 11 is a cross-section view of the roller assembly taken along sight line 11-11 seen in FIG. 10.
Figure 12:
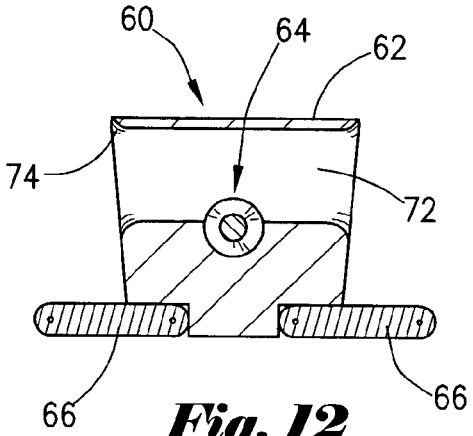
FIG. 12 is a side elevation cross-section view of the roller assembly.

Looking now at FIG. 8 we see that the high pressure wire-line conveyer assembly 12 includes the radial tubular member 54 which may be bent to any arc between 0 and 180 degrees, a removable coupling assembly 56 located at each end configured for adaptation to any pipe or tube connection composing the riser assembly 10. The coupling assemblies 56 may also be threadably adapted to box and pin joint connections, flange fittings or adaptively welded to pipe or tubing 58 as shown in FIG. 8. In any case, at least one of the coupling assemblies 56 must be removable from the tubular member 54 to allow for insertion and removal of the roller assembly 60. The roller assembly 60 as shown in more detail in FIG. 9 includes a plurality of cylinders 62 linked together in tandem. Each cylinder 62 has an aperture for passing the wire-line cable 16 supported upon a roller assembly 64. As seen in FIG. 10, each of the cylinders 62 is linked by a pin and connector 66, seen in cross section in FIG. 8 and in phantom here, allows the cylinders to articulate relative to each other thereby conforming to the radius of the tubular member 54. The Wire-line cable 16 is supported by a grooved roller 68 supported at each end by sealed bearings 70 as shown in FIG. 11. This arrangement insures that the cable 16 passing through the longitudinal aperture 72 remains in contact with the roller 64, thereby reducing binding and cut cables usually found when using sheaves. Each end of the cylinder 62 is tapered and flared to maximize free running of the cable 16 through the cylinder assembly 60 as seen in detail in FIG. 12.

Figure 13:
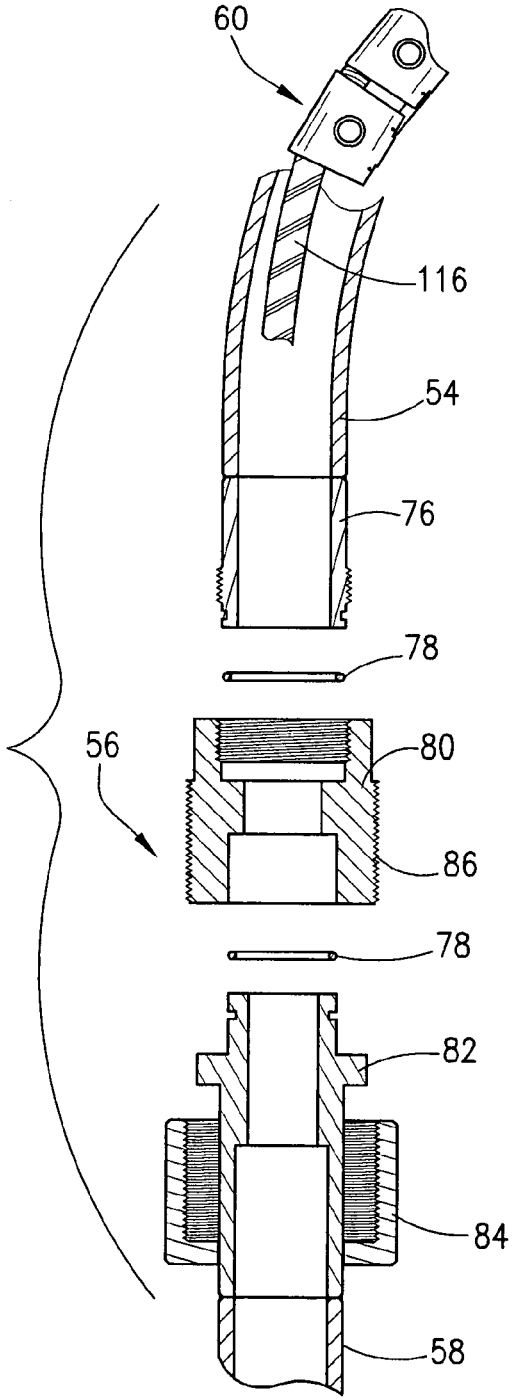
FIG. 13 is an exploded cross-section view of the coupling assembly.

Looking now at FIG. 13 the radial tube 54 housing the roller assembly 60 is attached to an adaptor member 76 having external threads and an O-ring seal 78. The threads 76 are cooperative with the internal threads of the body member 80 of the coupling assembly 56. A second adaptor member 82 is slidably connected to the body member 80 and sealed with a second O-ring 78' and fitted with a rotatable nut 84 having internal threads cooperative with external threads 86 located on the body member 80. The second adaptor is then adaptively attached to other tubular members of the riser assembly 10.

Figure 14:
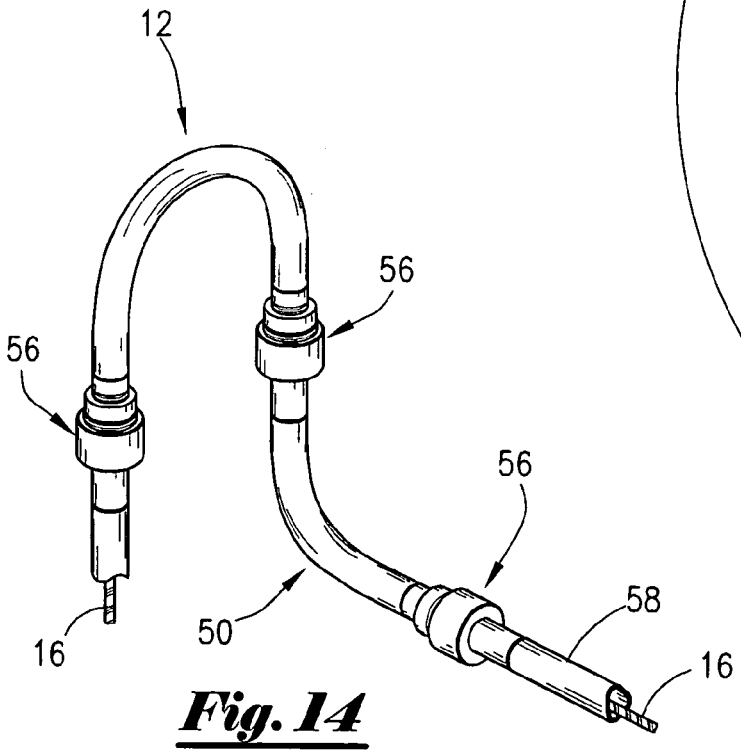
FIG. 14 is an isometric view of a 90-degree and 180-degree radial cable conveyer connected in tandem with ends in different planes.

It should be noted that although any arc with any radius desired may be used to convey the wire-line cable around such bends, it may be more practical to make up 90 or 180 degree assemblies and use combinations thereof for various applications which may include applications where each end of the assembly is in a different plane as seen in FIG. 14.

Figure 15:
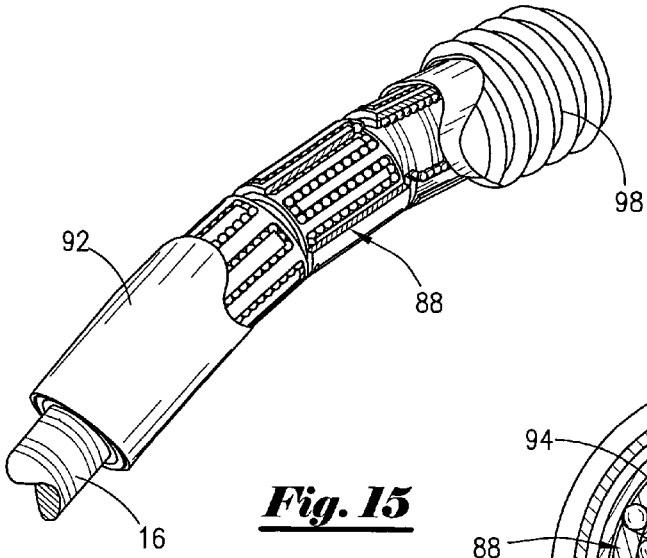
FIG. 15 is an isometric, cut-away view of a ball bearing wire-line cable carrier.
Figure 17:
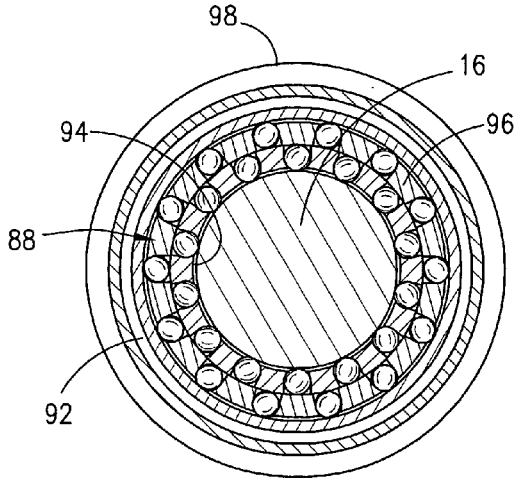
FIG. 17 is a cross-sectional end view of the ball bearing assemblies shown in FIG. 16.
Figure 15A:
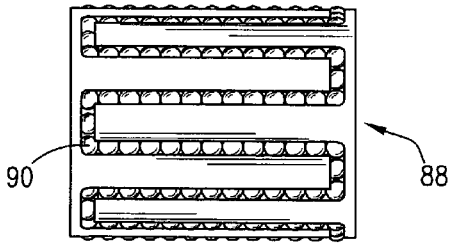
FIG. 15A is a cross-sectional side view of one of a plurality of ball bearing assemblies shown in FIG. 15.

The conveyance of a wire-line cable around a bend within a pressurized tubular member may be achieved by the alternative method illustrated in FIG. 15. As seen here, the wire-line cable 16 is threaded through a group of tubular bearing assemblies 88. Each of the tubular bearing assemblies 88 has a plurality internal and external rolling balls 90 that allows the cable 16 to pass freely through its longitudinal bore while allowing each bearing assembly 88 to rotate independently around the wire-line cable 16. The ball assemblies may be inserted and aligned in tandem into a semi-ridged housing 92 as seen in FIG. 15 and may carry wire-line cables 16 having diameters up to the maximum inner diameter of the bearing assemblies 88 as shown in FIG. 17. The balls 90 located in the bearing assemblies 88 may be arranged in a continuous row as seen in FIG. 15A or in spiral or any pattern that insures the most effect contact and support for the cable. The bearing assembly 88 is constructed utilizing an inner sleeve or race assembly 94 with the balls 90 extending inwardly towards the cable 16 and an external sleeve or race 96 with the balls 90 extending outwardly for contact with the inside diameter of semi-ridged tubular housing 92 in the manner shown in FIG. 17. Both the inner and outer races 94,96 revolve around the cable 16 as a unit. Balls 90 located within the outer race 96 roll against the inner surface of the semi-ridged tubular housing 92.

The tubular housing 92 may be preformed into an arc having a radius consistent with the bend radius of the cable being used up to 180 degrees or more as the job site dictates. Preformed tubular housing 92 must have sufficient wall thickness to with stand high pressures I excess of 10,000 PSI and therefore flexible hose etc are not generally considered for this application. However, utilizing a semi-ridged tubular housing 92 as an inner liner for a bearing surface enclosed telescopically within a heavy duty pressurizable flexible metal tube 98 such as a corrugated tube provides a deformable tubular assembly.

Figure 16:
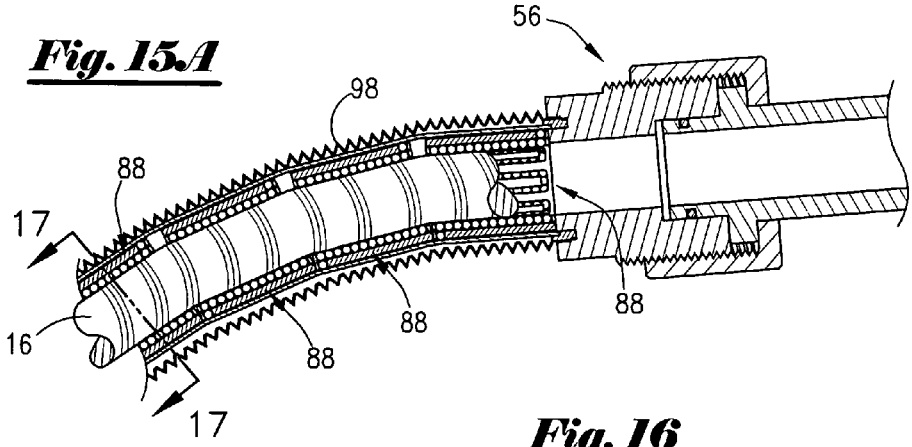
FIG. 16 is a cross-section view of the cable carrier assembly with end fittings.

Both the semi-ridge tubular 92 and the pressurizable flexible metal tubular 98 are attached at least at one end to a removable pressure fitting 56 as seen in FIG. 16. There are several types of high pressure flexible metal tubes available commercially any of which are generally acceptable to reinforce the semi-ridged tubular housing 92.

The ability to field form the semi-ridged tubular 92 and the flexible metal tube in double or single radial arches provides wire-line operators with tremendous advantages when rigging-up the well-head for wire-line operations.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. An enclosed, radial wire-line conveyor assembly comprising:

a) an arcuate elongated tubular member having a wall thickness capable of sustaining high pressure, fitted with a removable union coupling member attached to each end to allow recovery; of b) a plurality of independent wire-line cable conveying sleeve assemblies, located within the elongated tubular member and captured therein, each sleeve assembly having a plurality of internal and externally exposed ball bearings said externally exposed ball bearing in rolling contact with an inner surface of the elongated tubular member.

2. The enclosed, radial wire-line conveyor assembly according to claim 1 wherein the arcuate elongated tubular member forms an arch using 90 degree segments.

3. The enclosed, radial wire-line conveyor assembly according to claim 1 wherein the elongated tubular member is semi-rigid.

4. The enclosed, radial wire-line conveyor assembly according to claim 1 wherein the wire-line conveyor assembly further comprises a flexible metal tubular telescopically encompassing the elongated tubular member.

5. The enclosed, radial wire-line conveyor assembly according to claim 4 wherein the flexible metal tubular and the encompassed semi-rigid elongated tubular member and the cable conveying sleeve assemblies located therein are field connected one to another into serpentine arcs as required to meet specific job requirements.

6. The enclosed, radial wire-line conveyor assembly according to claim 4 wherein the flexible metal tubular is corrugated.

7. The enclosed, radial wire-line conveyor assembly according to claim 1 wherein each of the wire-line cable conveying sleeve assemblies being independent of each other, engage and freely rotate around a wire-line cable passed there through.

8. The enclosed, radial wire-line conveyor assembly according to claim 1 wherein said removable union coupling member permits rapid and orientationable coupling of one said enclosed, radial wire-line conveyor assembly to another enclosed, radial wire-line conveyor assembly.

9. A method for conveying a wire-line cable through a pressurized radial wire-line tubular riser assembly comprising the steps of:

a) installing at least one radial conveyor assembly within the riser assembly, comprised of an arch shaped pressureable, semi-rigid tubular member, fitted with a removable union coupling member attached to each end and having a plurality of independent sleeves rotatable relative to each other each having a plurality of ball bearings therein the sleeves captured within the conveyor assembly;

b) passing an end of a wire-line cable threadably through the tubular riser assembly including at least one said conveyor assembly prior to attaching said riser assembly to a well head; and c) pressurizing said wire line tubular riser assembly including said conveyor assembly.

10. The method according to claim 9 further comprising the step of incasing said semi-rigid tubular member telescopically within a flexible metal tubular.

11. The method according to claim 9 further comprising the step of field assembling a riser assembly using a plurality of radial conveyor assemblies forming serpentine arcs as desired to accommodate a wellhead wire-line riser assembly set-up having minimum height above a well head.

12. An enclosed, pressurizeable radial wire-line conveyor assembly comprising:

a) an elongated semi-rigid tubular member telescopically encased within a formable corrugated metal tubular having a union coupling member attached to each end; and b) a plurality of independently rotatable tubular bearing sleeves slidable within said flexible tubular each having a plurality of ball bearings the sleeves captured within the conveyor assembly by the union coupling members.

13. The enclosed, pressurizeable wire-line conveyor assembly according to claim 12 wherein the bearing sleeves comprise:

a) a first tubular sleeve having inner and outer diameters defining a wall there between the sleeve having a plurality of ball bearings retained within the confines of the wall, at least a portion of the ball bearings partially extending into the inner diameter of the sleeve; and b) a second tubular sleeve, fitted telescopically over the first sleeve, also having inner and outer diameters defining a wall there between and having a plurality of ball bearings retained within the confines of the wall, at least a portion of the ball bearings partially extending outwardly beyond the outer diameter of the sleeve.

* * * * *